US012225943B2

(12) United States Patent
Li et al.

(10) Patent No.: US 12,225,943 B2
(45) Date of Patent: Feb. 18, 2025

(54) ATOMIZER AND ELECTRONIC ATOMIZATION DEVICE

(71) Applicant: SHENZHEN SMOORE TECHNOLOGY LIMITED, Shenzhen (CN)

(72) Inventors: Xiaoping Li, Shenzhen (CN); Guanghui Li, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 508 days.

(21) Appl. No.: 17/618,331

(22) PCT Filed: Jun. 26, 2019

(86) PCT No.: PCT/CN2019/093036

§ 371 (c)(1),
(2) Date: Dec. 10, 2021

(87) PCT Pub. No.: WO2020/258079

PCT Pub. Date: Dec. 30, 2020

(65) Prior Publication Data

US 2022/0248764 A1 Aug. 11, 2022

(51) Int. Cl.

| | |
|---|---|
| ***A24F 40/485*** | (2020.01) |
| ***A24F 40/10*** | (2020.01) |
| ***A24F 40/42*** | (2020.01) |

(52) U.S. Cl.

CPC ..... *A24F 40/485* (2020.01); *A24F 40/10* (2020.01); *A24F 40/42* (2020.01)

(58) Field of Classification Search

CPC ..... A24F 40/485; A24F 40/10; A24F 40/42

(Continued)

(56) References Cited

U.S. PATENT DOCUMENTS

2014/0166030 A1* 6/2014 Li ..... A24F 40/485 131/329
2017/0042228 A1* 2/2017 Liu ..... A24F 40/50

(Continued)

FOREIGN PATENT DOCUMENTS

CN 105795522 A 7/2016
CN 105962420 A 9/2016

(Continued)

OTHER PUBLICATIONS

Office Action for Euorpean Application No. 19934871.5 mailed Nov. 25, 2022.

(Continued)

*Primary Examiner* — Gary F Paumen
(74) *Attorney, Agent, or Firm* — Dorsey & Whitney LLP

(57) ABSTRACT

An atomizer, comprising: a housing, an e-liquid storage cavity being provided in the housing; an atomization assembly, provided in the housing and provided with an air exchange channel, the air exchange channel being communicated with the outside and the e-liquid storage cavity, and the e-liquid storage cavity being used for storing e-liquid supplied to the atomization assembly; and an e-liquid separation piece, having air permeability and used for blocking the air exchange channel to absorb the e-liquid from the e-liquid storage cavity. External air can enter the e-liquid storage cavity by means of the air exchange channel and the e-liquid separation piece.

17 Claims, 7 Drawing Sheets

(58) Field of Classification Search
USPC ..... 131/329
See application file for complete search history.

(56) References Cited

U.S. PATENT DOCUMENTS

| | | | | |
|---|---|---|---|---|
| 2018/0338538 | A1* | 11/2018 | Zheng | A24F 40/48 |
| 2019/0029326 | A1 | 1/2019 | Qiu | |

FOREIGN PATENT DOCUMENTS

| | | | |
|---|---|---|---|
| CN | 207011690 | U | 2/2018 |
| CN | 108576938 | A | 9/2018 |
| CN | 106037009 | B | 10/2018 |
| CN | 109380769 | A | 2/2019 |
| CN | 211458849 | U | 9/2020 |
| EP | 3653066 | A2 | 5/2020 |
| GB | 2542011 | A | 3/2017 |
| WO | 2018041063 | A1 | 3/2018 |

OTHER PUBLICATIONS

Written Opinion dated Mar. 23, 2020 for International Application No. PCT/CN2019/093036.
International Search Report from International Application No. PCT/CN2019/093036 mailed Mar. 23, 2020.
First Office Action for Chinese Application No. 201910561462.3 mailed Dec. 22, 2023.

* cited by examiner

ATOMIZER AND ELECTRONIC ATOMIZATION DEVICE

TECHNICAL FIELD

The present disclosure relates to the field of electronic atomizing technology, in particular to an atomizer and an electronic atomizing device including the atomizer.

BACKGROUND

An electronic atomizing device generally includes an atomizer and a power supply assembly. However, when the conventional atomizer atomizes the e-liquid, the negative pressure generated during the gradual consumption of the e-liquid will result in poor supply of e-liquid. The atomizer will produce a burnt smell due to insufficient e-liquid supply, which will further affect the user's inhaling experience.

SUMMARY

A technical problem solved by the present disclosure is how to avoid the atomizer from being burnt.

An atomizer includes:

a housing provided with a liquid storage cavity therein;

an atomizing assembly disposed in the housing and provided with a ventilation passage, the ventilation passage being in communication with outside and the liquid storage cavity, the liquid storage cavity being configured to store liquid supplied to the atomizing assembly; and a liquid spacer having air permeability and configured to block the ventilation passage to absorb the liquid from the liquid storage cavity, wherein outside air is capable of passing through the ventilation passage and the liquid spacer and entering the liquid storage cavity.

An electronic atomizing device includes the atomizer as described above.

BRIEF DESCRIPTION OF THE DRAWINGS

In order to describe the technical solutions in the embodiments of the present disclosure or the prior art more clearly, the drawings that need to be used in the description of the embodiments or the prior art will be briefly introduced below. Apparently, the drawings in the following description only illustrate some embodiments of the present disclosure. For those of ordinary skill in the art, other drawings can be obtained based on these drawings without creative work.

DETAILED DESCRIPTION OF THE EMBODIMENTS

Figure 1:
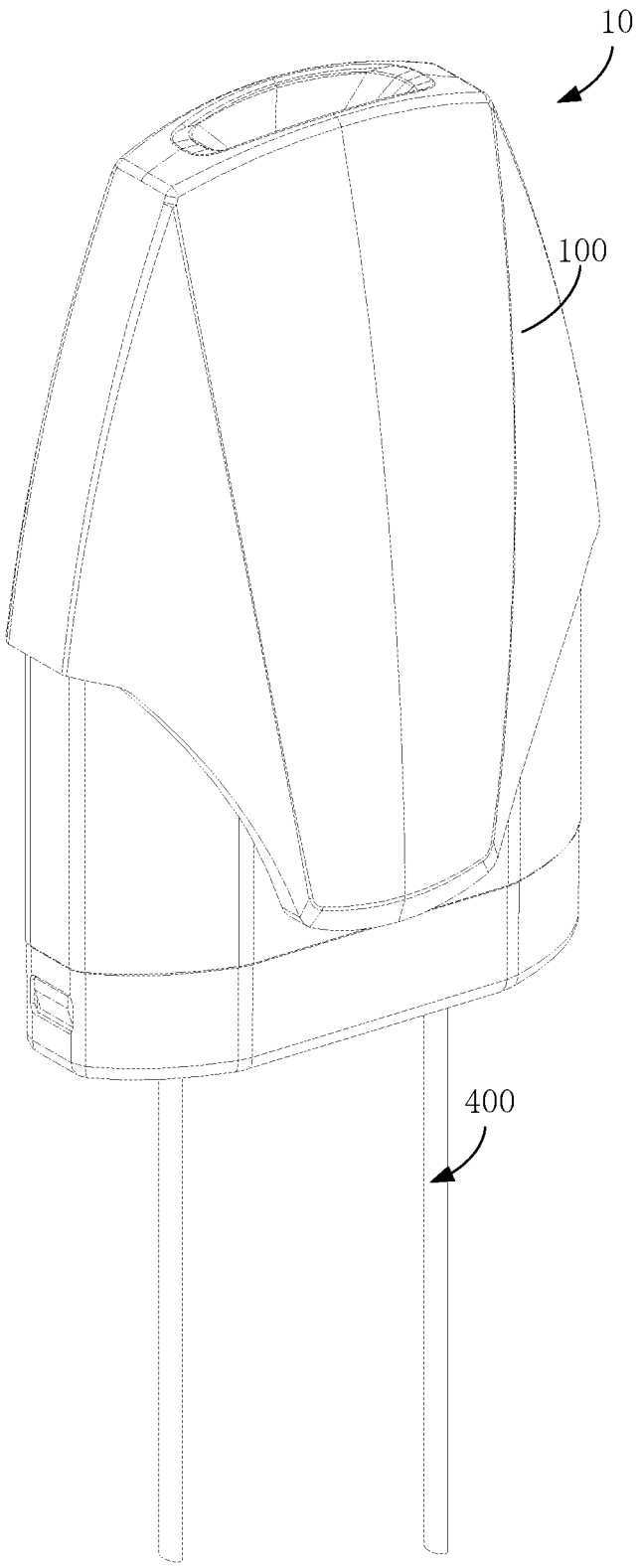
FIG. 1 is a perspective view of an atomizer according to an embodiment.

In order to facilitate the understanding of the present disclosure, the present disclosure will be described in a more comprehensive manner with reference to the relevant drawings. Preferred embodiments of the present disclosure are shown in the drawings. However, the present disclosure can be implemented in many different forms and is not limited to the embodiments described herein. On the contrary, the purpose of providing these embodiments is to make the disclosure of the present disclosure more thorough and comprehensive.

It should be noted that when an element is referred to as being "fixed to" another element, it can be directly on another element or an intermediate element may also be present. When an element is considered to be "connected to" another element, it can be directly connected to another element or an intermediate element may be present at the same time. Terms "inner", "outer", "left", "right" and similar expressions used herein are for illustrative purposes only, and do not mean that they are the only embodiments.

Figure 2:
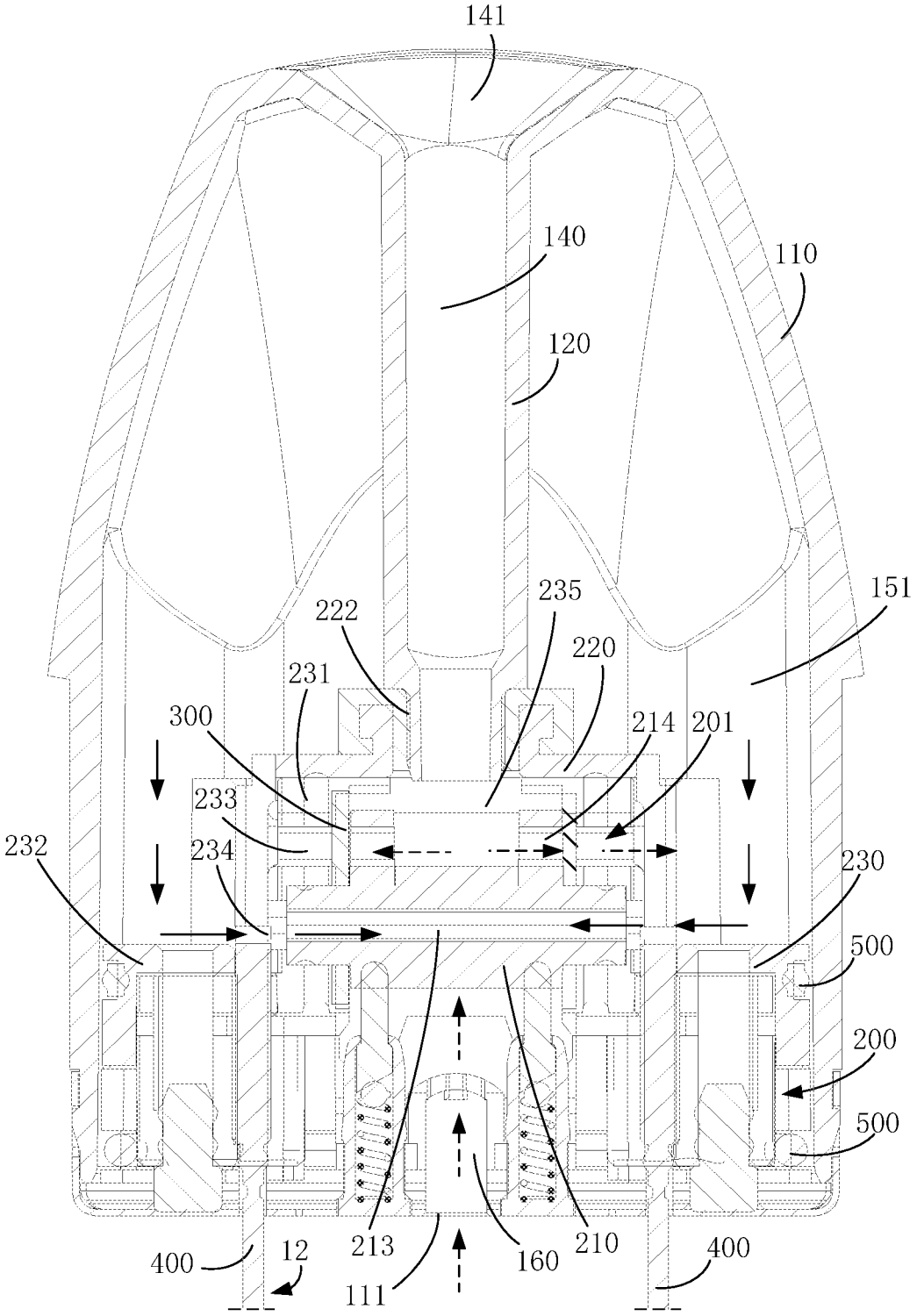
FIG. 2 is a cross-sectional schematic view of an on-off valve of FIG. 1 in a second station.
Figure 3:
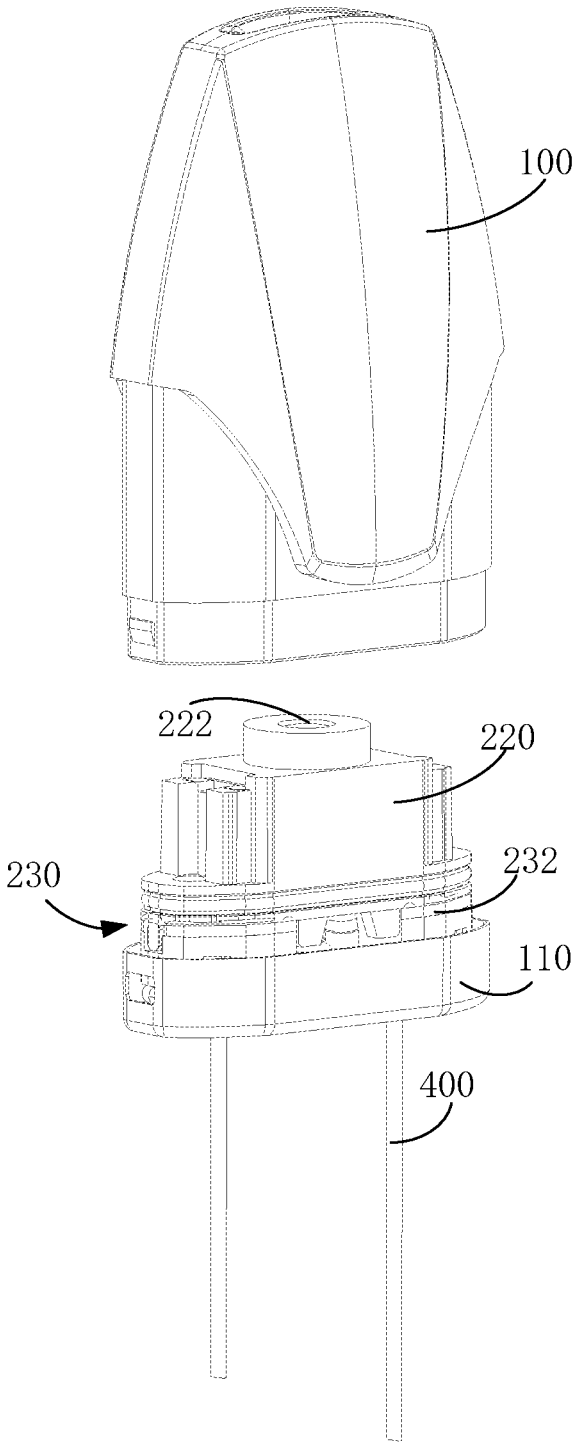
FIG. 3 is an exploded schematic view of FIG. 1.
Figure 4:
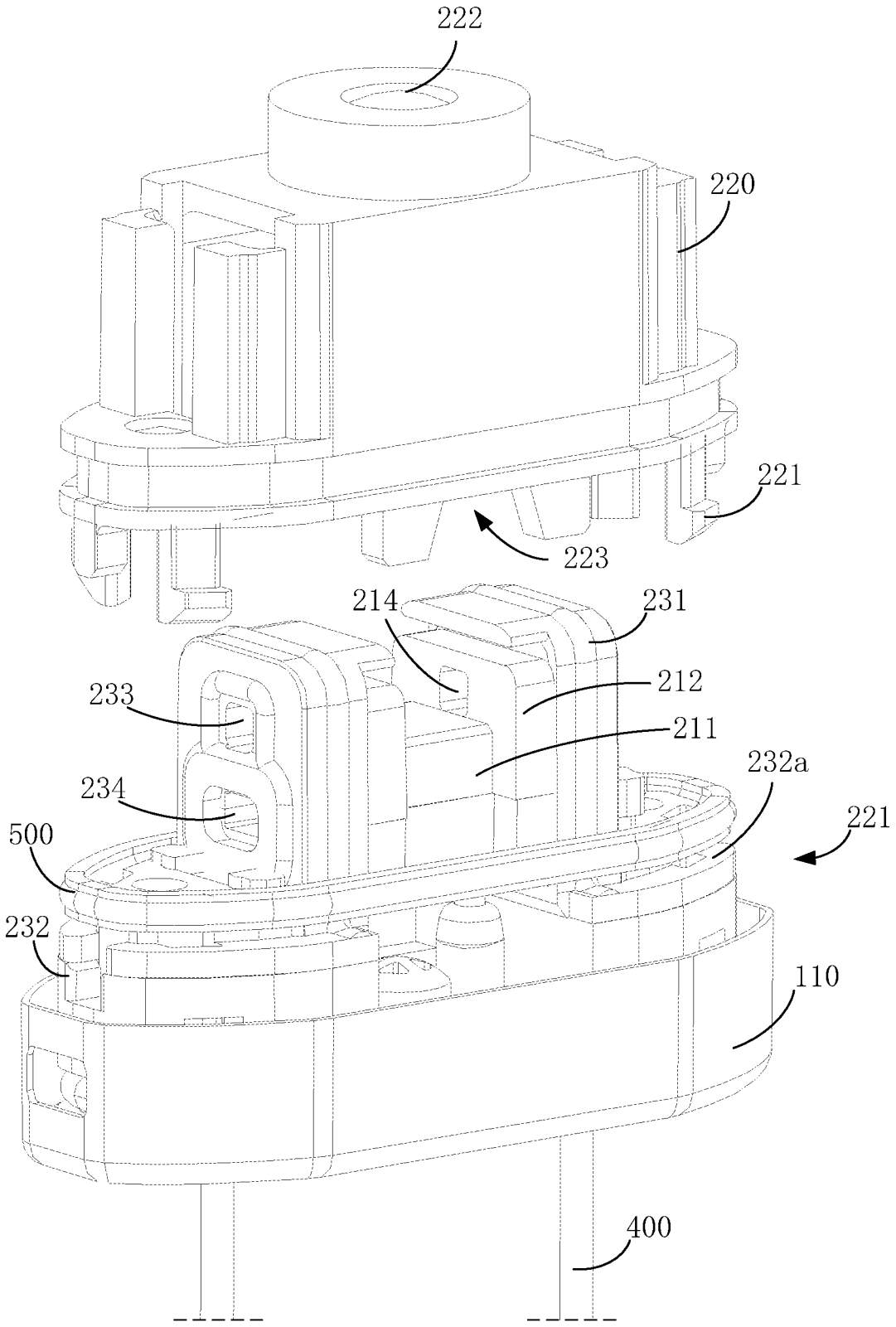
FIG. 4 is an exploded schematic view of FIG. 3 according to a first embedment, where a part of housing is removed.

Referring to FIGS. 1 and 2, an atomizer 10 according to an embodiment of the present disclosure can be used to atomize liquid represented by an aerosol generating substrate. The atomizer 10 includes a housing 100, an atomizing assembly 200, a liquid spacer 300, an on-off valve 400, and a sealing member 500.

Figure 7:
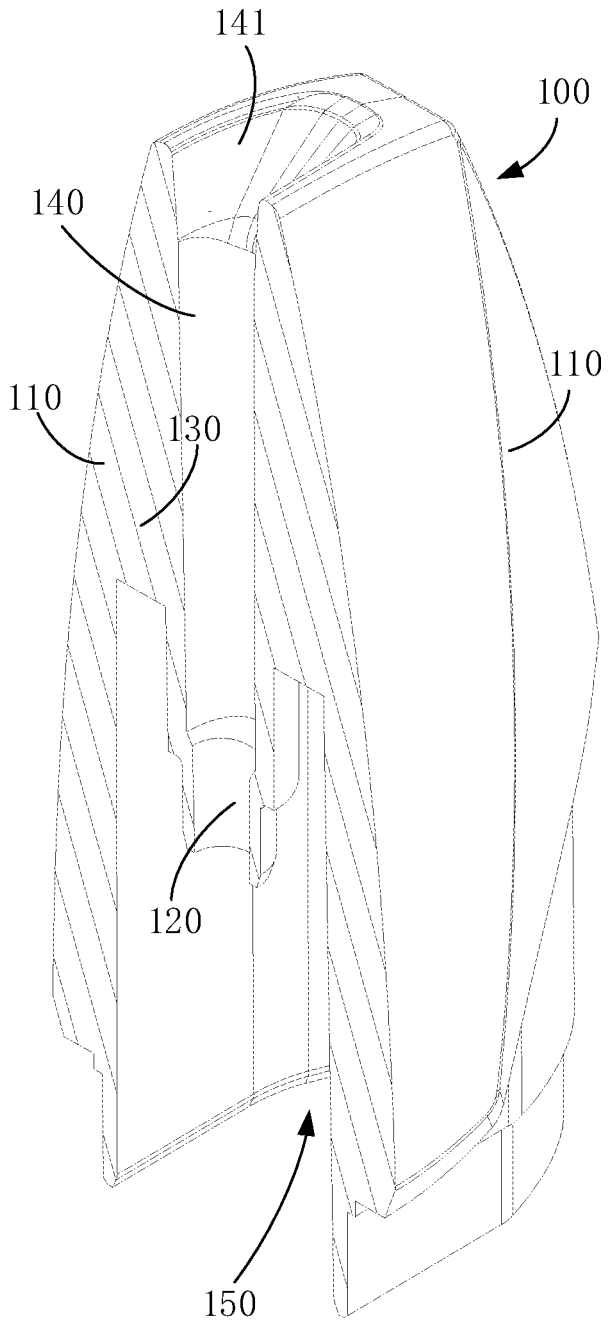
FIG. 7 is a partial perspective cross-sectional view of a housing of FIG. 3.
Figure 8:
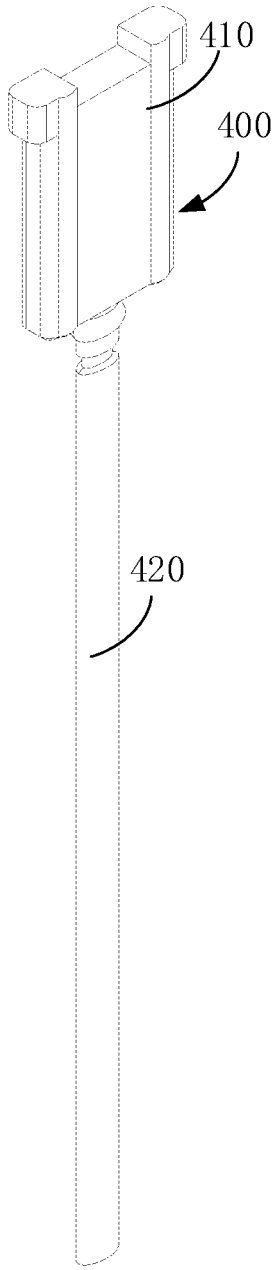
FIG. 8 is a perspective view of the on-off valve of FIG. 3.

Referring to FIGS. 1, 2, and 7, in some embodiments, the housing 100 includes a shell portion 110, an inserting portion 120, and a reinforcing rib 130. The shell portion 110 encloses a receiving cavity 150. The inserting portion 120 is vertically disposed in the receiving cavity 150. An upper end of the inserting portion 120 is connected to the shell portion 110. The atomizing assembly 200 is accommodated in the receiving cavity 150. The atomizing assembly 200, the shell portion 110, and the inserting portion 120 enclose a part of the receiving cavity 150 into a liquid storage cavity 151. The liquid storage cavity 151 is used for storing liquid. The inserting portion 120 is provided with an inhaling passage 140. The inhaling passage 140 extends along an axial direction of the inserting portion 120. The inhaling passage 140 can be in communication with outside. During the inhaling process, the liquid is atomized by the atomizing assembly 200 to form aerosol. The aerosol can be inhaled by a user via the inhaling passage 140.

The reinforcing rib 130 is connected to the upper end of the inserting portion 120. Two reinforcing ribs 130 can be provided. The two reinforcing ribs 130 are disposed symmetrically with respect to the inserting portion 120. The reinforcing ribs 130 are further connected to the shell portion 110. That is, the reinforcing ribs 130 are connected between the inserting portion 120 and the shell portion 110. Since the inserting portion 120 has a certain length and is suspended in the receiving cavity 150 of the housing 100, by providing the reinforcing rib 130, the stability when mounting the inserting portion 120 can be improved.

Referring to FIGS. 2 to 6, in some embodiments, the atomizing assembly 200 includes an atomizing core 210, a top cover 220, and a base 230. The top cover 220 is provided with an accommodating cavity 223 that is in communication with the liquid storage cavity 151. The atomizing core 210 is located in the accommodating cavity 223. The base 230 includes a first mounting portion 231 and a second mounting portion 232 that are connected to each other. The first mounting portion 231 is located in the accommodating cavity 223 of the top cover 220, and the second mounting portion 232 is located outside the accommodating cavity 223 of the top cover 220. The second mounting portion 232 is provided with a stepped surface 232*a*. The stepped surface 232*a* is located on an edge of the second mounting portion 232 and extends along a circumferential direction of the second mounting portion 232. The top cover 220 abuts against the stepped surface 232*a*. The stepped surface 232*a* provides good positioning when the top cover 220 is mounted. The top cover 220 is provided with a catch 221, and the second mounting portion 232 is provided with a catch hole. With cooperation of the catch 221 and the catch hole, a detachable snap connection between the top cover 220 and the base 230 can be realized.

Referring to FIG. 2, the second mounting portion 232 of the base 230 is provided with an airflow passage 160. The airflow passage 160 is in communication with the inhaling passage 140. The shell portion 110 of the housing 100 is provided with an air inlet 111. The air inlet 111 is in communication with the outside and the airflow passage 160. That is, the airflow passage 160 is in communication with the outside via the air inlet 111. During the inhaling process, outside air enters the user's mouth via the airflow passage 160 and the inhaling passage 140.

The atomizing core 210 is used to absorb the liquid in the liquid storage cavity 151 and atomize the liquid to form aerosol for the user to inhale. The atomizing core 210 can be made of porous ceramic material. The porous ceramic material has a good capillary function to ensure that the atomizing core 210 has a good liquid absorption function. Certainly, liquid molecules can pass through the atomizing core 210 made of porous ceramic material. Since gas molecules have a smaller diameter and viscosity than those of liquid molecules, and the gas molecules can also pass through the atomizing core 210, the atomizing core 210 made of porous ceramic material also has good air permeability. The atomizing core 210 can also be made of other porous materials with better liquid storage performance and air permeability.

Figure 6:
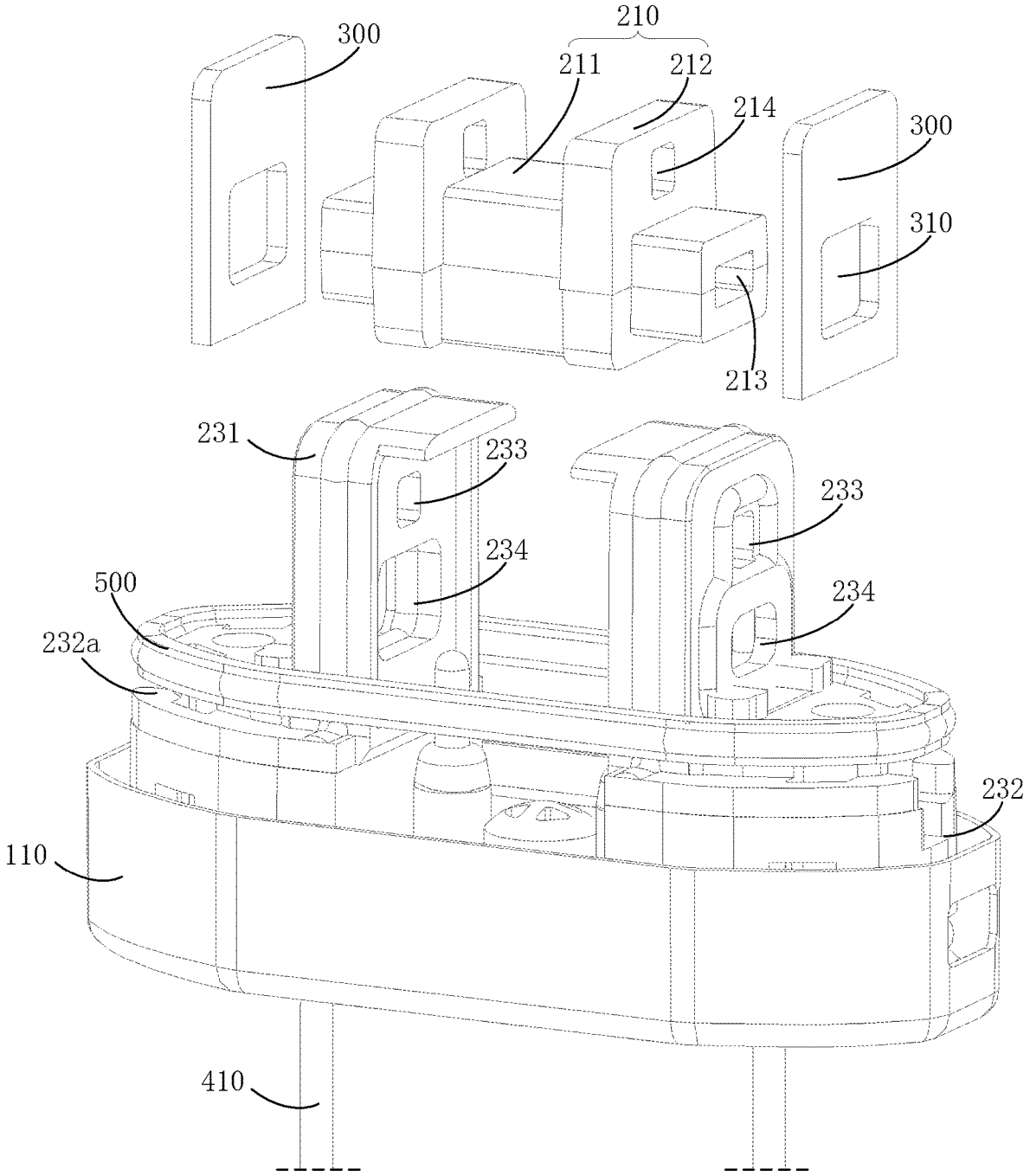
FIG. 6 is an exploded schematic view of FIG. 3 according to a third embedment, where a part of housing is removed.

Referring to FIGS. 2 and 6, the atomizing core 210 includes a body portion 211 and a flange portion 212 that are connected to each other. The body portion 211 is generally cylindrical or prismatic. The flange portion 212 is disposed around the body portion 211. The flange portion 212 can extend a set length with respect to a surface of the body portion 211 along a direction at a set angle with an axial direction of the body portion 211. For example, the flange portion 212 extends in a direction perpendicular to the axial direction of the body portion 211. In other embodiments, the atomizing core 210 may only be provided with the body portion 211 having a columnar shape, and the flange portion 212 is not provided on the body portion 211.

In some embodiments, the body portion 211 of the atomizing core 210 is provided with a liquid guiding passage 213 therein. Both ends of the liquid guiding passage 213 are in communication with the liquid storage cavity 151. The liquid guiding passage 213 may be disposed laterally. That is, the liquid guiding passage 213 is perpendicular to the vertically disposed inhaling passage 140. By providing the liquid guiding passage 213, the liquid in the liquid storage cavity 151 can directly enter the inside of the atomizing core 210 via the liquid guiding passage 213, thereby improving the liquid guiding efficiency of the atomizing core 210. In addition, the liquid is distributed more uniformly in the atomizing core 210, which prevents the atomizing core 210 from generating dry burning due to insufficient local liquid supply, thereby preventing the burnt smell generated by the dry burning. In other embodiments, the liquid guiding passage 213 may not be provided, that is, the atomizing core 210 directly absorbs the liquid from the liquid storage cavity 151 through capillary action to atomize the liquid.

Figure 5:
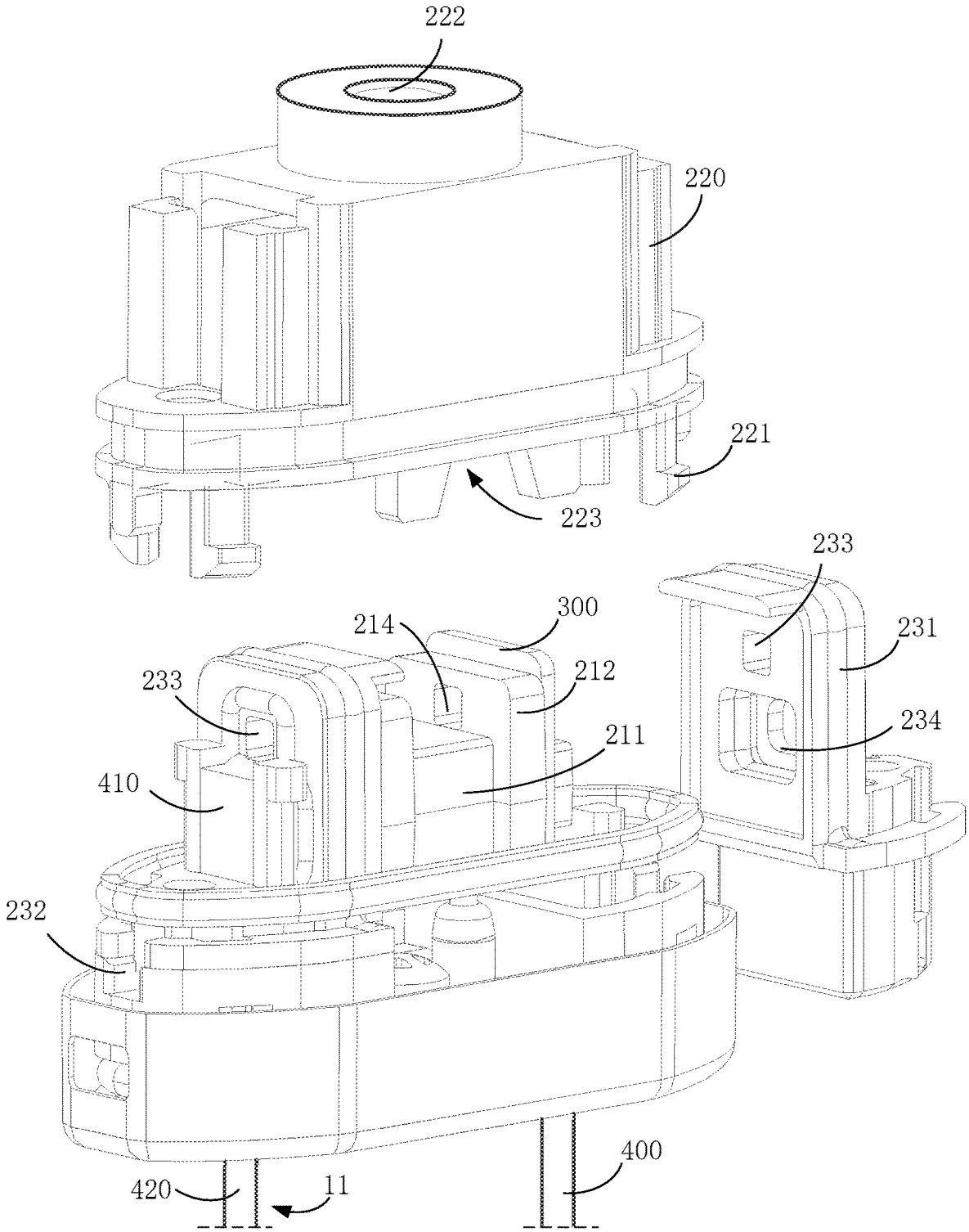
FIG. 5 is an exploded schematic view of FIG. 3 according to a second embedment, where a part of housing is removed.

Referring to FIGS. 2, 5, and 6, the on-off valve 400 includes a pulling portion 420 and a blocking portion 410 that are connected to each other. The pulling portion 420 is in a rod shape. A part of the pulling portion 420 can extend through the base 230 and be exposed to the base 230. The blocking portion 410 is in a plate shape. The blocking portion 410 can be slidably connected to the top cover 220 and the base 230. The pulling portion 420 is used to drive the blocking portion 410 to slide linearly. Specifically, the on-off valve 400 has a first station 11 (see FIG. 5) and a second station 12 (see FIG. 2). Before the atomizer 10 is used, the on-off valve 400 is in the first station 11, the blocking portion 410 of the on-off valve 400 can block the liquid guiding passage 213, preventing the liquid in the liquid storage cavity 151 from entering the liquid guiding passage 213 and from leaking out of the atomizing core 210, thereby effectively preventing liquid leakage of the entire atomizer 10 during its storage or transportation. When the atomizer 10 is in use, a pulling force can be applied to the pulling portion 420 to move the on-off valve 400 from the first station 11 to the second station 12, so that the blocking portion 410 opens the liquid guiding passage 213. In this case, the liquid in the liquid storage cavity 151 can quickly enter the atomizing core 210 via the liquid guiding passage 213 to be atomized. The atomizer 10 may be a disposable atomizer 10. When the on-off valve 400 is in the second station 12, the pulling portion 420 can be pulled apart to be separated from the blocking portion 410, and the broken pulling portion 420 can be discarded. In other embodiments, the on-off valve 400 can be rotated with respect to the atomizing core 210. That is, the on-off valve 400 is rotatably connected to the entire atomizing assembly 200, as long as the rotatable on-off valve 400 can open or block the liquid guiding passage 213.

In some embodiments, in terms of materials, the liquid spacer 300 may be liquid spacing cotton. The liquid spacing cotton may be a non-woven fabric, organic cotton, ecological cotton, and the like, the components of which are plant fibers. The liquid spacing cotton has good air permeability, so that the air can pass through the liquid spacing cotton from one side of the liquid spacing cotton and enter the other side of the liquid spacing cotton. In addition, the liquid spacing cotton has good liquid absorption. That is, the liquid spacing cotton has a strong absorption effect on liquid, so that the liquid cannot flow through the liquid spacing cotton from one side of the liquid spacing cotton and flow into the other side of the liquid spacing cotton, thereby ensuring that the liquid spacing cotton can obstruct the flow of the liquid. In terms of shape, the liquid spacer 300 may have a plate-like structure.

Referring to FIGS. 2 to 6, the flange portion 212 is provided with a via hole 214. The base 230, the top cover 220, and the atomizing core 210 enclose an atomizing cavity 235. The via hole 214 forms a part of the atomizing cavity 235. The atomizing core 210 atomizes the liquid to form aerosol, the aerosol can flow out of the inhaling passage 140 via the atomizing cavity 235. The atomizing cavity 235 is in communication with the inhaling passage 140 and the airflow passage 160. The liquid spacer 300 is provided with a mounting hole 310. The body portion 211 of the atomizing core 210 extends through the mounting hole 310 to facilitate the positioning when the liquid spacer 300 is mounted. The flange portion 212 is pressed against the inner side of the liquid spacer 300. The first mounting portion 231 of the base 230 is pressed against the outer side of the liquid spacer 300. That is, the liquid spacer 300 is sandwiched between the flange portion 212 and the first mounting portion 231. In this case, the liquid spacer 300 can block a port of the via hole 214 away from the atomizing cavity 235.

The first mounting portion 231 is provided with a first through hole 233 and a second through hole 234. The first through hole 233 can be in communication with the liquid storage cavity 151. Both the first through hole 233 and the atomizing cavity 235 together form a ventilation passage 201. The end of the body portion 211 of the atomizing core 210 can be inserted into the second through hole 234. The second through hole 234 plays a good positioning function when the atomizing core 210 is mounted. In addition, the liquid in the liquid storage cavity 151 can enter the liquid guiding passage 213 via the second through hole 234. When the on-off valve 400 is in the first station 11, the blocking portion 410 of the on-off valve 400 blocks the second through hole 234 to prevent the liquid in the liquid storage cavity 151 from entering the liquid guiding passage 213 via the second through hole 234. When the on-off valve 400 is in the second station 12, the blocking portion 410 of the on-off valve 400 opens the second through hole 234, so that the liquid in the liquid storage cavity 151 smoothly passes through the second through hole 234 and enters the liquid guiding passage 213. The solid arrow in FIG. 2 indicates the flow direction of the liquid.

Since the liquid spacer 300 blocks the port of the via hole 214 away from the atomizing cavity 235, the liquid in the liquid storage cavity 151 cannot pass through the second through hole 234 to flow through the liquid spacer 300 and enter the via hole 214, preventing the liquid from blocking the entire ventilation passage 201, further preventing the liquid from entering the atomizing cavity 235, the airflow passage 160 and the inhaling passage 140, and ensuring that the air introduced via the airflow passage 160 quickly enters the liquid storage cavity 151. In addition, the flange portion 212 has a larger contact area with the liquid spacer 300, and thus the liquid absorbed on the liquid spacer 300 can be absorbed by the flange portion 212 for atomization. As such, the liquid absorption capacity of the liquid spacer 300 can be released in time, ensuring that the liquid spacer 300 can be used for a long time and play a function of obstructing the flow of liquid.

During the inhaling process, as the liquid is continuously atomized and consumed, the liquid in the liquid storage cavity 151 is reduced, and the space of the liquid storage cavity 151 is released. In this case, the outside air can pass through the airflow passage 160, the atomizing cavity 235, the via hole 214, the liquid spacer 300, and the first through hole 233 in sequence and enter the liquid storage cavity 151. The dotted arrow in FIG. 2 indicates the flow direction of the air. The air will fill in the space of the liquid storage cavity 151 where no liquid exists. The filling air can effectively increase the air pressure in the liquid storage cavity 151. The air pressure acts on the remaining liquid in the liquid storage cavity 151 to ensure that the liquid storage cavity 151 smoothly supplies the liquid to the atomizing core 210, avoiding the defect of insufficient liquid supply of the atomizing core 210 due to the vacuum or negative pressure in the liquid storage cavity 151, and preventing the insufficient liquid supply from causing a burnt smell that affects the inhaling experience.

Therefore, by providing the ventilation passage 201 and making full use of the good air permeability of the liquid spacer 300, it can be ensured that the outside air passes through the airflow passage 160, the ventilation passage 201, and the liquid spacer 300, and enters the liquid storage cavity 151, to avoid the negative pressure in the liquid storage cavity 151 due to vacuum, which ensures that the liquid in the liquid storage cavity 151 can flow into the atomizing core 210 smoothly, and prevents the atomizing core 210 from being burnt due to insufficient liquid supply. Moreover, the good liquid absorption function of the liquid spacer 300 is fully exerted, the liquid in the liquid storage cavity 151 is prevent from filling in the entire ventilation passage 201 to form an obstructive effect on the flow of air, and it is ensured that the air introduced via the airflow passage 160 quickly enters the liquid storage cavity 151. The liquid spacer 300 has better liquid storage and liquid guiding functions. When the liquid supply of the atomizing core 210 is insufficient or the liquid spacer 300 is full of liquid, since the liquid spacer 300 is adjacent to the atomizing core 10, the liquid absorbed and stored by the liquid spacer 300 is introduced to the atomizing core 210 to improve the liquid guiding efficiency and relieve the scorch that may be caused by insufficient liquid supply.

In some embodiments, the top cover 220 is provided with a fixing hole 222 that is in communication with the atomizing cavity 235. An end of the inserting portion 120 cooperates with the fixing hole 222, so that the fixing hole 222 is in communication with the inhaling passage 140. The sealing member 500 may be a sealing ring. The sealing ring is embedded on the second mounting portion 232 of the base 230. When a part of the second mounting portion 232 cooperates with the receiving cavity 150, the sealing ring is pressed between the second mounting portion 232 and an inner wall surface of the shell portion 110. The sealing member 500 can play a sealing role to prevent the liquid in the liquid storage cavity 151 from leaking via a gap between the second mounting portion 232 and the shell portion 110.

When the user inhales, firstly, the pulling portion 420 is pulled downward, and the entire on-off valve 400 moves from the first station 11 to the second station 12, so that the blocking portion 410 opens the second through hole 234 and the liquid guiding passage 213. Then, the liquid in the liquid storage cavity 151 quickly enters the atomizing core 210 via the liquid guiding passage 213 for atomization. The end of the inhaling passage 140 forms a nozzle 141 on the inserting portion 120, and the user can inhale the aerosol at the nozzle 141.

The present disclosure also provides an electronic atomizing device. The electronic atomizing device includes a power supply assembly and the atomizer 10 as described above. The power supply assembly is connected to the atomizer 10. The power supply assembly is used to heat the atomizing core 210 to atomize the liquid.

The technical features of the above embodiments can be combined arbitrarily. To simplify the description, not all possible combinations of the technical features in the above embodiments are described. However, all of the combinations of these technical features should be considered as being fallen within the scope of the present disclosure, as long as such combinations do not contradict with each other.

The foregoing embodiments merely illustrate some embodiments of the present disclosure, and descriptions thereof are relatively specific and detailed. However, it should not be understood as a limitation to the patent scope of the present disclosure. It should be noted that, a person of ordinary skill in the art may further make some variations and improvements without departing from the concept of the present disclosure, and the variations and improvements falls in the protection scope of the present disclosure. Therefore, the protection scope of the present disclosure shall be subject to the appended claims.

What is claimed is:

1. An atomizer, comprising:

a housing provided with a liquid storage cavity therein;

an atomizing assembly disposed in the housing and provided with a ventilation passage, the ventilation passage being in communication with outside and the liquid storage cavity, the liquid storage cavity being configured to store liquid supplied to the atomizing assembly; and a liquid spacer having air permeability and configured to block the ventilation passage to absorb the liquid from the liquid storage cavity, wherein outside air is capable of passing through the ventilation passage and the liquid spacer and entering the liquid storage cavity.

2. The atomizer according to claim 1, wherein the atomizing assembly comprises an atomizing core, the atomizing core is provided with a liquid guiding passage that is capable of being in communication with the liquid storage cavity.

3. The atomizer according to claim 2, further comprising an on-off valve, wherein the on-off valve is capable of moving with respect to the atomizing core, the on-off valve has a first station and a second station, the on-off valve blocks the liquid guiding passage at the first station and opens the liquid guiding passage at the second station.

4. The atomizer according to claim 3, wherein the on-off valve slides linearly between the first station and the second station.

5. The atomizer according to claim 3, wherein the on-off valve comprises a pulling portion and a blocking portion that are connected to each other, the pulling portion is in a rod shape and is capable of extending through and being exposed to the atomizing assembly; the blocking portion is in a plate shape and is configured to block the liquid guiding passage, and the pulling portion is configured to drive the blocking portion to move.

6. The atomizer according to claim 1, wherein the atomizing assembly comprises a base, a top cover, and an atomizing core that are connected to each other; the base, the top cover, and the atomizing core cooperatively enclose an atomizing cavity; the base comprises a first mounting portion, the first mounting portion is provided with a first through hole that is in communication with the liquid storage cavity and the atomizing cavity; the liquid spacer is pressed against the first mounting portion and blocks an opening of the first through hole adjacent to the atomizing cavity; the first through hole and the atomizing cavity form the ventilation passage.

7. The atomizer according to claim 6, wherein the atomizing core comprises a body portion and a flange portion that are connected to each other; the flange portion extends a set length with respect to a surface of the body portion along a direction at a set angle with an axial direction of the body portion; the flange portion is provided with an via hole; the via hole is in communication with the first through hole and forms a part of the atomizing cavity, and the liquid spacer is sandwiched between the first mounting portion and the flange portion.

8. The atomizer according to claim 7, wherein the first mounting portion is further provided with a second through hole, the liquid in the liquid storage cavity is capable of entering the atomizing core via the second through hole.

9. The atomizer according to claim 6, wherein the liquid spacer is provided with a mounting hole, and the atomizing core extends through the mounting hole.

10. The atomizer according to claim 6, wherein the base is provided with an airflow passage that is in communication the ventilation passage, the housing is provided with an air inlet, the airflow passage is in communication the outside via the air inlet.

11. The atomizer according to claim 6, wherein the base further comprises a second mounting portion connected to the first mounting portion; an edge of the second mounting portion is provided with a stepped surface extending along a circumferential direction of the second mounting portion; the top cover abuts against the stepped surface and is in a snap connection with the second mounting portion.

12. The atomizer according to claim 1, wherein the the liquid spacer comprises liquid spacing cotton.

13. The atomizer according to claim 1, wherein the housing comprises a shell portion and an inserting portion; the shell portion encloses a receiving cavity; the inserting portion is connected to the shell portion and is disposed in the receiving cavity; the atomizing assembly, the shell portion, and the inserting portion enclose a part of the receiving cavity to form the liquid storage cavity, the inserting portion is provided with an inhaling passage that is in communication with the outside and the airflow passage.

14. The atomizer according to claim 13, wherein the atomizing assembly is provided with a fixing hole, and an end of the inserting portion cooperates with the fixing hole.

15. The atomizer according to claim 1, wherein the housing further comprises a reinforcing rib connected between an end of the inserting portion and the shell portion.

16. The atomizer according to claim 1, further comprising a sealing member pressed between the atomizing assembly and the housing.

17. An electronic atomizing device, comprising the atomizer according to claim 1.

* * * * *